US010405626B2

(12) United States Patent
Gonitianer et al.

(10) Patent No.: US 10,405,626 B2
(45) Date of Patent: Sep. 10, 2019

(54) CLOSURE FOR A RECEPTACLE

(71) Applicant: BS Systems GmbH & Co. KG, Zusmarshausen (DE)

(72) Inventors: Reiner Gonitianer, Dillingen (DE); Volker Amann, Augsburg (DE)

(73) Assignee: BS SYSTEMS GMBH & CO. KG, Zusmarshausen (DE)

( * ) Notice: Subject to any disclaimer, the term of this patent is extended or adjusted under 35 U.S.C. 154(b) by 341 days.

(21) Appl. No.: 15/024,053

(22) PCT Filed: Sep. 3, 2014

(86) PCT No.: PCT/EP2014/068714
§ 371 (c)(1),
(2) Date: Mar. 23, 2016

(87) PCT Pub. No.: WO2015/039868
PCT Pub. Date: Mar. 26, 2015

(65) Prior Publication Data

US 2016/0213115 A1 Jul. 28, 2016

(30) Foreign Application Priority Data

Sep. 23, 2013 (DE) ..... 10 2013 110 496

(51) Int. Cl.
*A45C 13/10* (2006.01)
*E05B 1/00* (2006.01)
(Continued)

(52) U.S. Cl.
CPC ..... *A45C 13/10* (2013.01); *A45C 5/03* (2013.01); *A45C 13/1076* (2013.01); *B25H 3/02* (2013.01);
(Continued)

(58) Field of Classification Search
CPC . A45C 13/1084; A45C 13/1076; A45C 13/14; A45C 5/03; E05B 1/0084
(Continued)

(56) References Cited

U.S. PATENT DOCUMENTS 4,671,943 A * 6/1987 Wahlquist ..... A61L 2/26 422/300
4,820,499 A * 4/1989 Taschner ..... A61L 2/26 206/438
(Continued)

FOREIGN PATENT DOCUMENTS

DE 102006002475 A1 7/2006
DE 202005015040 U1 8/2006
(Continued)

OTHER PUBLICATIONS

International Search Report dated Dec. 16, 2014 for International Application No. PCT/EP2014/068714.
(Continued)

*Primary Examiner* — Mollie Impink
(74) *Attorney, Agent, or Firm* — Paul D. Bianco; Thomas Grzesik; Fleit Gibbons Gutman Bongini & Bianco PL

(57) ABSTRACT

A closure for a receptacle having two receptacle parts, the closure being arranged on a first receptacle part and having a first connecting element for detachably connecting to a complementary, second connecting element of the second receptacle part. A shaft for holding an information carrier is also provided.

10 Claims, 4 Drawing Sheets

(51) Int. Cl.

| | |
|---|---|
| ***E05B 17/22*** | (2006.01) |
| ***B25H 3/02*** | (2006.01) |
| ***A45C 5/03*** | (2006.01) |

(52) U.S. Cl.
CPC ..... *E05B 1/0084* (2013.01); *E05B 17/226* (2013.01); *A45C 13/1084* (2013.01)

(58) Field of Classification Search
USPC ..... 206/459.5; 292/307 R
See application file for complete search history.

(56) References Cited

U.S. PATENT DOCUMENTS

| | | | | |
|---|---|---|---|---|
| 5,379,887 | A | 1/1995 | Conley, Jr. | |
| 6,880,869 | B2 * | 4/2005 | Schainholz | A61L 2/28 292/307 A |
| 7,573,385 | B2 | 8/2009 | Tonelli | |
| 8,677,661 | B2 | 3/2014 | Michels et al. | |
| 2003/0102970 | A1 | 6/2003 | Creel et al. | |
| 2006/0049640 | A1 | 3/2006 | Lee | |
| 2006/0170558 | A1 | 8/2006 | Tonelli | |
| 2008/0251396 | A1 | 10/2008 | Oh | |
| 2011/0147256 | A1 | 6/2011 | Atherton et al. | |
| 2011/0186397 | A1 | 8/2011 | Sheikh | |
| 2011/0233096 | A1 | 9/2011 | Michels et al. | |

FOREIGN PATENT DOCUMENTS

| | | | |
|---|---|---|---|
| GB | 2459288 | A | 10/2009 |
| WO | 0125701 | A1 | 4/2001 |
| WO | 2011032568 | A1 | 3/2011 |

OTHER PUBLICATIONS

Result of examination report for German Application No. 10 2013 110 496.7, filed Sep. 23, 2013.
Written Opinion for International Application No. PCT/EP2014/068714 dated Mar. 26, 2015.
English translation of Written Opinion dated Jan. 29, 2016 for International Application No. PCT/EP2014/068714.
English translation of International Preliminary Report on Patentability dated Mar. 29, 2016 for International Application No. PCT/EP2014/068714.

* cited by examiner

CLOSURE FOR A RECEPTACLE

FIELD OF THE INVENTION

The invention concerns a closure for a receptacle as well as a receptacle with such a closure.

BACKGROUND

Receptacles used for the transport of technical objects, like tools, spare and small parts, are known from the prior art. The receptacles usually have a receptacle cover and receptacle bottom and are closed by means of a closure on the receptacle cover or receptacle bottom. The receptacles also have means to accommodate information carriers, labels, signs or cards. Such a receptacle arrangement is known, for example, from WO 2011/032568 A1. The contents being transported can be made recognizable by the information carriers both in closed receptacles and open receptacles. This can involve purely optical information carriers and also information carriers that can be read and written to wirelessly. The holder for such an information carrier is formed on the receptacle arrangements, especially on the receptacle walls of the receptacle cover or the receptacle bottom. The use of information carriers in the holder occurs by insertion into the correspondingly formed holder. The holder for an information carrier must be considered during the manufacture of the receptacle. The refitting of receptacles with such a holder for information carriers is not possible. It would be conceivable to glue the information carrier to the receptacle arrangement. The replacement or removal of the information carrier, however, is then not easily possible.

DE 20 2005 015 040 U1 discloses a closure for a receptacle with two receptacle parts, in which the closure is arranged on a first receptacle part and has a first connecting means for detachable connection to a complementary second connecting means. In addition, the document shows a key/lock system in which the receptacle can be opened with a key.

US 2011/0147256 A1 shows a receptacle with a security device, which is designed in the form of a shaft, which consists of two parts and has a view window. An insert is pushed into the parts, in which case an RFID tag is glued over the two inserts. The receptacle can only be opened if the RFID tag is destroyed. The window is provided for positioning and removal of the RFID tag on the two inserts.

US 2011/0186397 A1 discloses a receptacle or case with a biometric lock mechanism. The receptacle has a biometric lock and a biometric reader with a memory on one half-shell, which serves to close the two half-shells. In another embodiment, the sliding handles can be locked in the lock.

DE 10 2006 002 475 A1 shows a wearable multipurpose receptacle with an identifiable content with two half-shells and a transponder, which is mounted on a support. The transponder is readable by means of a radio frequency signal and provides information concerning the content of the receptacle. The transponder or support is also rigidly connected to the outside surface of one of the two half-shells. In other embodiments the support is integrated in the material of the half-shells. The support can also be arranged on any part of the receptacle, for example, connected to the handle.

SUMMARY OF THE INVENTION

At least some embodiments of the invention are directed to a receptacle can be simply and cost effectively equipped and also retrofitted with a holder for an information carrier.

Accordingly, disclosed herein are a closure and a receptacle with such a closure. Advantageous embodiments of the invention are also disclosed.

The closure according to the invention is characterized by a shaft to accommodate an information carrier. The closure consists of an individual part simple to manufacture and thereby permits inexpensive production. Owing to the combining of the information carrier in the receptacle closure, the retrofitting of the receptacles is possible in order to provide them with an information carrier. In this case, only the old closure need be replaced with the closure according to the invention.

In a particularly advantageous embodiment, the shaft of the closure has fastening devices that are designed for the detachable securing of the information carrier. These can be formed, for example, as elastic retaining tabs and arranged on two opposite sides of the shaft. Mounting and securing of the information carrier from falling out of the closure also permits simple removal or replacement of the information carrier.

According to a useful embodiment, the closure can be pivoted about a pivot axis on the first receptacle part, the shaft running essentially perpendicular to the pivot axis of the closure.

In another useful embodiment, the shaft has a recess through which the accommodated information carrier is visible from the outside.

In another advantageous embodiment, the shaft is formed with a flat cross section to accommodate a disk-like information carrier.

BRIEF DESCRIPTION OF THE DRAWINGS

Further details and advantages of the invention are apparent from the following description of a preferred embodiment example with reference to the drawing. In the drawing.

DETAILED DESCRIPTION OF THE INVENTION

Figure 1:
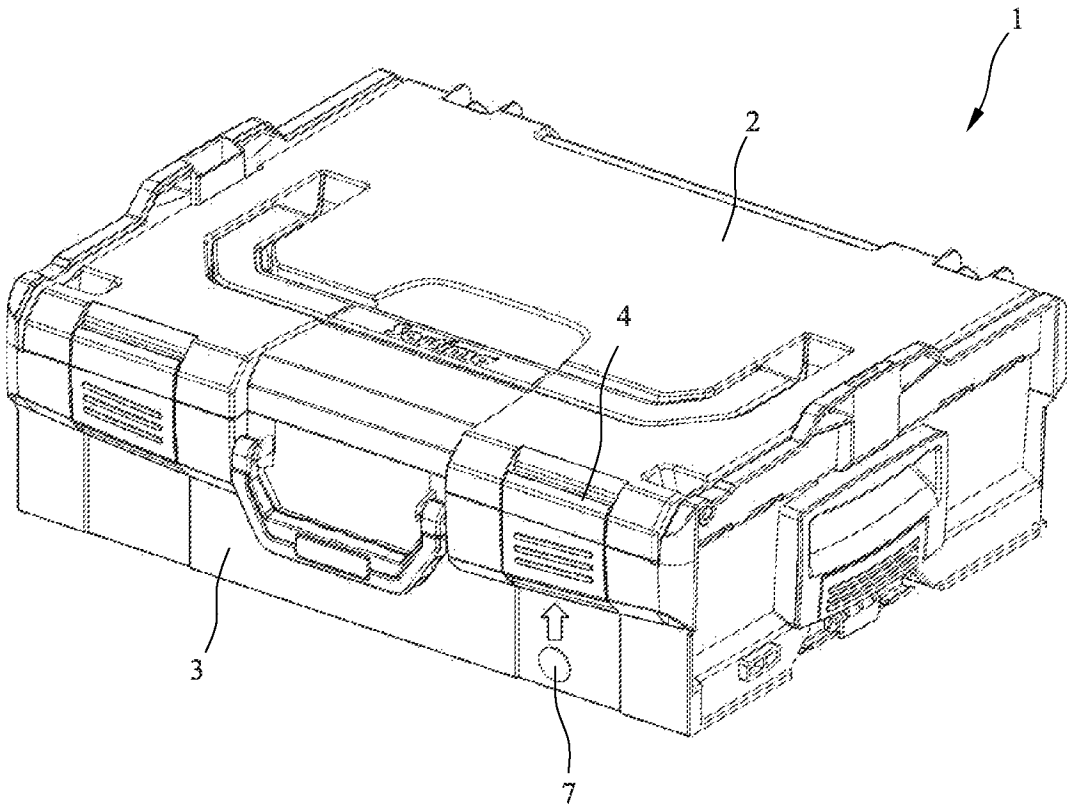
FIG. 1 shows a perspective view of a closure arranged on the receptacle.

A perspective view of a closure on a receptacle 1 is shown in FIG. 1, which comprises two receptacle parts 2, 3, which are closed in a closed state by means of closure 4 in order to permit transport of the receptacle. The closure 4 is then arranged on a first receptacle part 2 and has first connecting means 5 for detachable connection with complementary second connecting means 6 of the second receptacle part 3. The information carrier 7 can be used both in the closed position of closure 4, i.e., when the receptacle parts 2, 3 are closed and the closure closes the two receptacle parts 2, 3, and in the open position of the closure 4.

Figure 2:
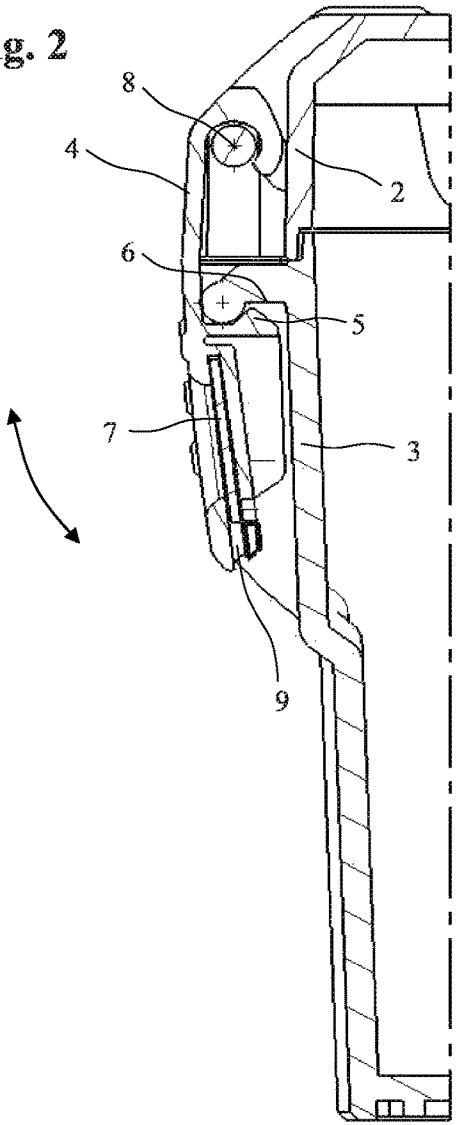
FIG. 2 shows a sectional view of the closure with the accommodated information carrier.

As can be deduced from FIG. 2, the closure 4 according to the invention is shown in a sectional view with an accommodated information carrier 7 preferably consisting of a plastic material. As already described, the closure 4 is arranged on the first receptacle part 2 and has a pivot axis 8, about which the closure 4 arranged on the receptacle part 2 can be pivoted. For closure and locking of the two receptacle parts 2, 3 the closure 4 has first connecting means 5 in the form of protrusions, which snap into complementary second connecting means 6. The second connecting means 6 can be a recess which is formed on the second receptacle 3.

A shaft 9 is provided in closure 4 to accommodate the information carrier 7, into which the information carrier 7 can be inserted. The shaft 9 then runs essentially perpendicular to the pivot axis 8 of closure 4.

Figure 3:
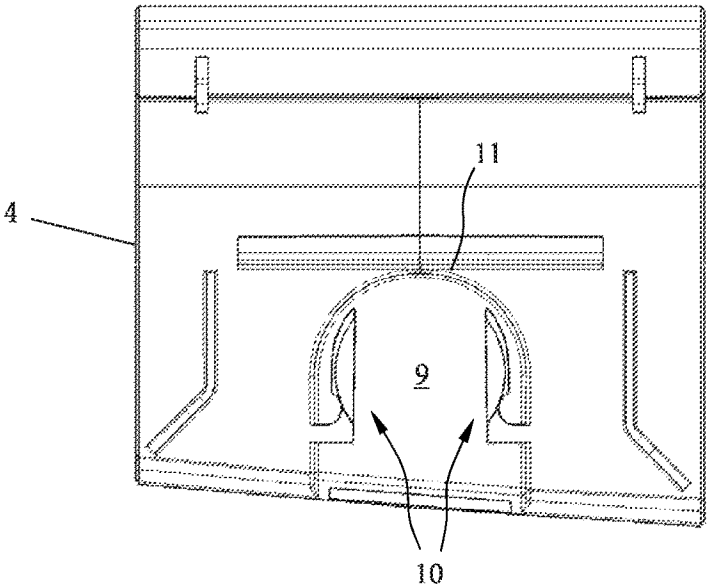
FIG. 3 shows a depiction of the back side of the closure.

For detachable securing of the information carrier 7, fastening means 10 are provided according to FIG. 3 into shaft 9, which are designed as elastic retaining tabs and are arranged on opposite sides of shaft 9. The information carrier 7 is preferably designed to be disk-like, for which reason the shaft 9 has a flat cross section and a semicircular end 11 to accommodate the disk-like information carrier 7.

Figure 4:
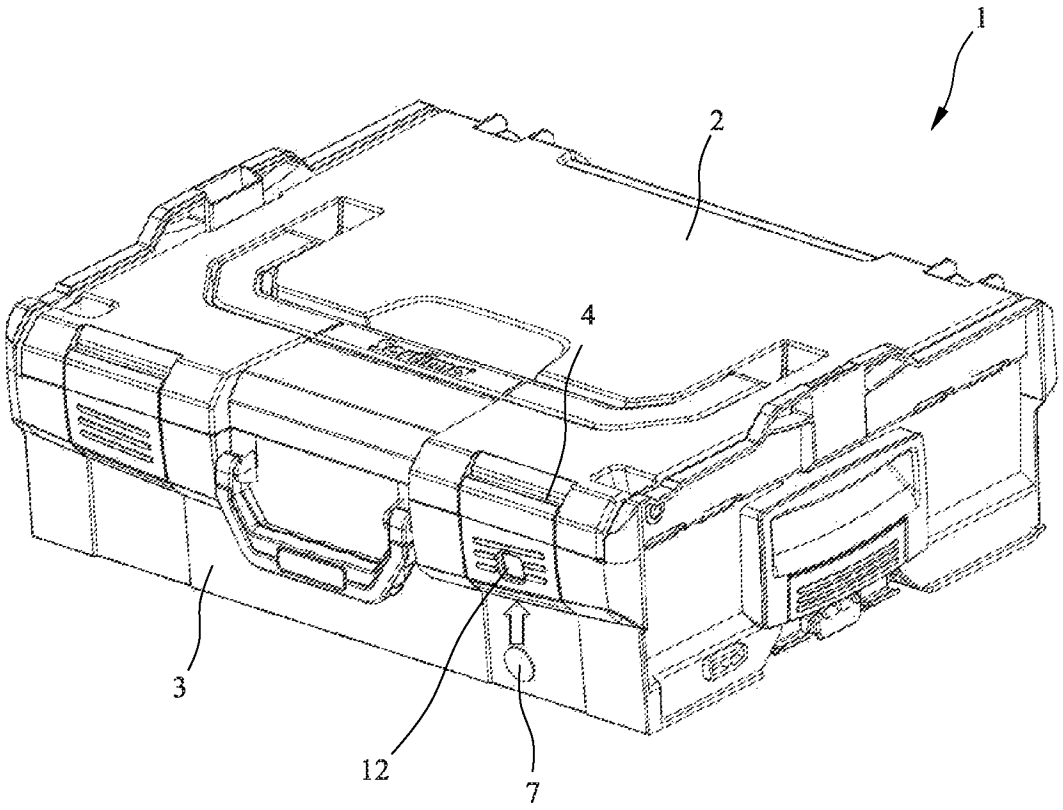
FIG. 4 shows a perspective view of a closure with a recess arranged on a receptacle.
Figure 5:
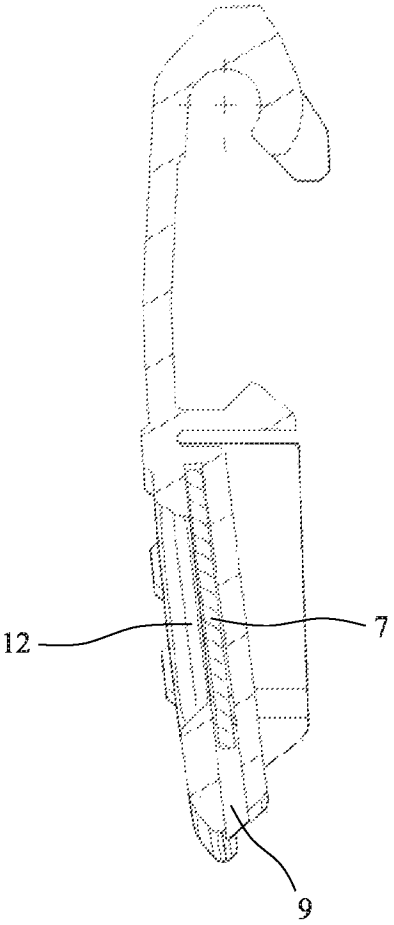
FIG. 5 shows a sectional view of the closure with recess and accommodated information carrier.

In another embodiment, which is shown in FIGS. 4 to 5, the same reference numbers are used to the extent that they correspond to the features of the previous figures. The closure 4 shown in FIG. 4 has a recess 12, through which the accommodated information carrier 7 is visible from the outside.

As is apparent from FIG. 5, the normal line of the recess 12 then runs essentially perpendicular to the shaft 9 of closure 4. The inserted information carrier 7 is optically recognizable because of recess 12.

The information carrier 7 used in the two embodiment examples are optical, RFID or NFC information carriers, whose data can be read manually or mechanically. When the RFID or NFC technique is used, a recess 12 is not necessary to read the data stored on the information carrier. Instead of using intelligent data carriers, the use of information carriers designed in the form of colored chips or those provided with icons would also be conceivable.

As an alternative to disk-like information carriers 7, card-like information carriers can also be used.

In an alternative embodiment, not shown, the closure 4 is not arranged to be pivotable on the first receptacle part 2 but movable horizontally or vertically in one plane. By movement of closure 4, the closed receptacle parts 2, 3 are closed. The information carrier 7 is also accommodated in the closure 4 via a shaft 9.

The invention claimed is:

1. A closure for a receptacle with two receptacle parts in which the closure is arranged on a first receptacle part and has first connecting means for detachable connection with complementary second means of a second receptacle part, wherein the closure includes a shaft to accommodate an information carrier, which carries information concerning the contents of the receptacle, the shaft being circumscribed by a plurality of walls forming one or more portions of the first connecting means, wherein the shaft has fastening means that are designed for detachable securing of the information carrier in the shaft, the fastening means comprising two elastic retaining tabs arranged on opposite sides of the shaft.

2. The closure according to claim 1, wherein the closure is arranged to be pivotable about a pivot axis on the first receptacle part.

3. The closure according to claim 2, wherein a direction of insertion of the information carrier into the shaft is perpendicular to the pivot axis of the closure.

4. The closure according to claim 1, wherein the shaft has a recess, through which the accommodated information carrier is visible from outside the shaft.

5. The closure according to claim 4, wherein a normal of the recess at a visible plan of the recess runs essentially perpendicular to the shaft.

6. The closure according to claim 1, wherein the shaft is designed with a flat cross section to accommodate a disk-like information carrier.

7. The closure according to claim 1, wherein the shaft has a semicircular end to accommodate an optical information carrier.

8. The closure according to claim 1, further including the information carrier, wherein the information carrier is an optical, RFID or NFC information carrier.

9. A receptacle with two receptacle parts and at least one closure according to claim 1.

10. A closure for a receptacle with two receptacle parts in which the closure is arranged on a first receptacle part and has first connecting means for detachable connection with complementary second means of a second receptacle part, wherein the closure includes a shaft to accommodate an information carrier, which carries information concerning the contents of the receptacle, the shaft being circumscribed by a plurality of walls forming one or more portions of the first connecting means, wherein the shaft has fastening means comprising two elastic retaining tabs arranged on opposite sides of the shaft and formed from a portion of at least one wall of the plurality of walls, the two elastic retaining tabs are configured to be elastically displaced by contact with the information carrier for detachable securing of the information carrier in the shaft.

* * * * *